US005152878A

United States Patent [19]

Datta et al.

[11] Patent Number: 5,152,878

[45] Date of Patent: Oct. 6, 1992

[54] METHOD FOR ELECTROCHEMICAL CLEANING OF METAL RESIDUE ON MOLYBDENUM MASKS

[75] Inventors: Madhav Datta, Yorktown Heights, N.Y.; Karl U. Rocheleau, St. Albans, Vt.

[73] Assignee: International Business Machines Corporation, Armonk, N.Y.

[21] Appl. No.: 806,993

[22] Filed: Dec. 31, 1991

[51] Int. Cl.[5] ..... C25F 1/00

[52] U.S. Cl. ..... 204/141.5

[58] Field of Search ..... 204/141.5

[56] References Cited

PUBLICATIONS

G. E. Melvin, B. R. Taylor & S. W. Taylor, *Mask Cleaning Process,* IBM Technical Disclosure Bulletin, vol. 13, No. 8 at 2156 (Jan. 1971).

H. S. Hoffman, *Molybdenum Cleaning Solution,* IBM Technical Disclosure Bulletin, vol. 3, No. 5 at 36 (Oct. 1960).

*Primary Examiner*—T. M. Tufariello

*Attorney, Agent, or Firm*—Ratner & Prestia

[57] ABSTRACT

An electrochemical method for selective removal of the metallic residual stain which forms on molybdenum masks during processing of integrated circuits. The method forms an electrolytic cell which has, as its elements, the mask as the anode, an electrolyte of phosphoric acid and glycerol, a cathode, and a power supply. That cell is used to electrochemically clean the mask, forming a surface film and electrolyte layer on the mask which includes the metallic residual stain. To remove the surface film and electrolyte layer and, concurrently, the metallic residual stain, the mask is rinsed with water. It is then dried.

19 Claims, 3 Drawing Sheets

METHOD FOR ELECTROCHEMICAL CLEANING OF METAL RESIDUE ON MOLYBDENUM MASKS

BACKGROUND OF INVENTION

1. Field of Invention

The present invention relates, in general, to a method for cleaning metal masks used in fabricating integrated circuits. More particularly, the present invention relates to a method for electrochemical cleaning, of the metal residue which forms on molybdenum masks during processing of integrated circuits, using a phosphoric acid-based solution.

2. Description of Related Art

Often, metal masks are used repeatedly and cyclically in integrated circuit processing. Consequent metallic residue (build-up or stack) is one source of problematic mask defects. After a given cycle of processing is completed, therefore, the mask is separated from the wafer substrate and chemically cleaned to remove the metallurgical stack. Such cleaning leaves behind a layer of metallic residue which stains the mask. Those stains influence the via size of the mask; thus, they limit the number of times (cycles) the mask can be used. Moreover, the polyimide layer of the substrate (which acts as an intermetal dielectric) has been found to contain particles of metal embedded in its surface after processing with stained masks.

In fabricating controlled collapsible chip connection ("C4") technology, molybdenum masks are generally used. Such masks present an additional problem for the typical chemical cleaning process given masks: the process must remove the metal residue without attacking the base molybdenum. It has been found that conventional chemical cleaning processes are unable to address that problem satisfactorily.

With the above discussion in mind, it is one object of the present invention to provide an improved process for removing metal residue from molybdenum masks without chemically attacking the molybdenum. A second object is to assure that the process is adaptable to manufacturing needs. A related object is to provide a process which is fast, on the order of one or two minutes. Also of advantage, and a further object, is a process which increases the number of cycles for which a given mask can be used without requiring further cleaning.

SUMMARY OF THE INVENTION

To achieve these and other objects, and in view of its purposes, the present invention provides an electrochemical method for selective removal of metallic residual stain from a molybdenum mask. The method forms an electrolytic cell which has, as its elements, the mask as the anode, an electrolyte of phosphoric acid and glycerol, a cathode, and a power supply. That cell is used to electrochemically clean the mask, forming a surface film and electrolyte layer on the mask which includes the metallic residual stain. To remove the surface film and electrolyte layer and, concurrently, the metallic residual stain, the mask is rinsed with water. It is then dried.

It is to be understood that both the foregoing general description and the following detailed description are exemplary, but are not restrictive, of the invention.

BRIEF DESCRIPTION OF THE DRAWINGS

The invention is best understood from the following detailed description when read in connection with the accompanying drawings, in which.

DETAILED DESCRIPTION OF THE INVENTION

Figure 1:
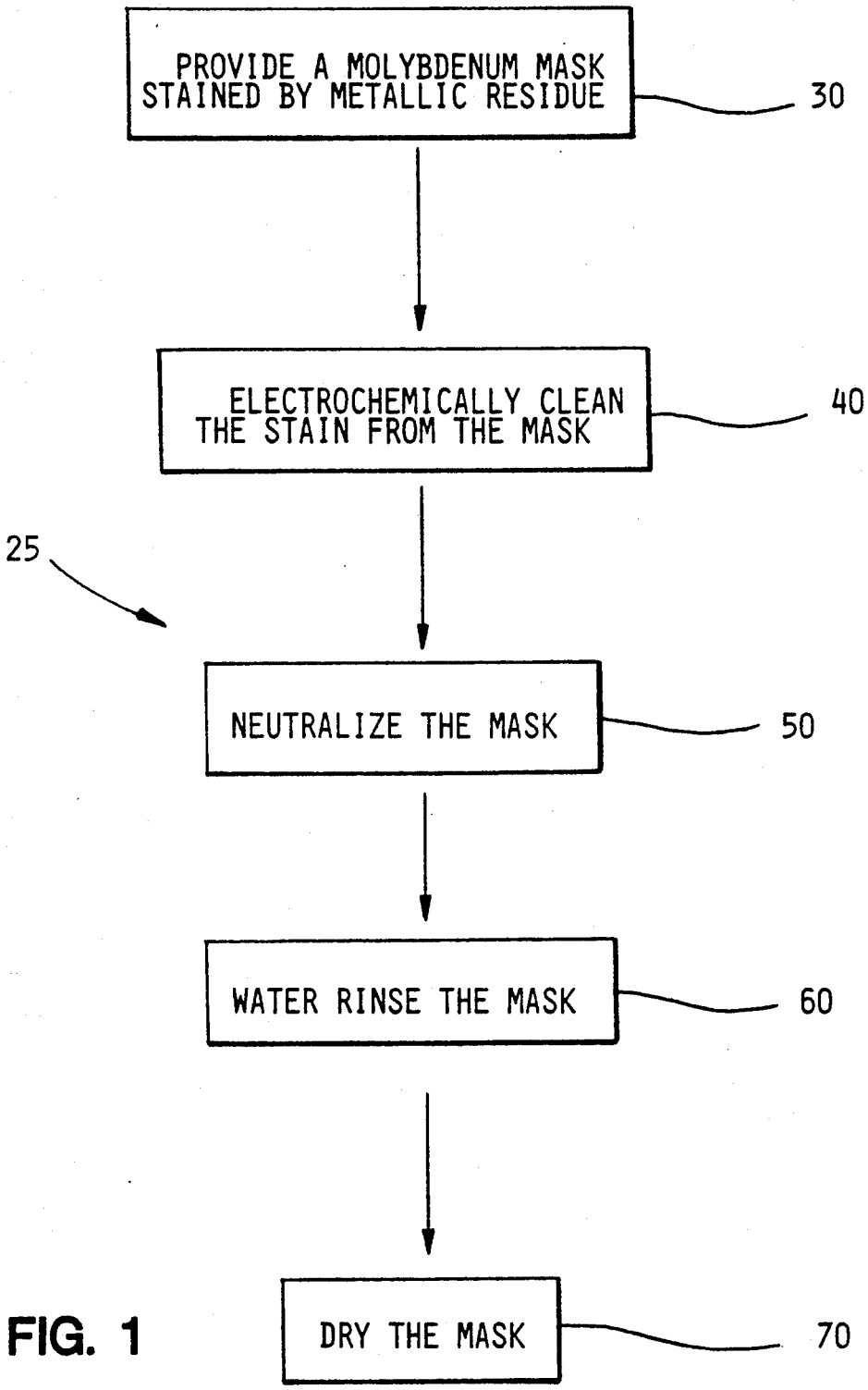
FIG. 1 is a flow chart illustrating the process of the present invention.

Complementary metal-oxide semiconductors (CMOS), which use both p-type and n-type (complementary) metal-oxide semiconductors to form circuits, are fabricated using masks. Specifically, in C4 technology, molybdenum masks are usually used for selective physical vapor deposition by evaporation of terminal metals on the substrate. A heated source vaporizes atoms or molecules of the metal to be deposited. The metal particles then strike the substrate, through the mask, and thereby are deposited. Metal particles are also deposited, of course, on the mask. When several metal layers are deposited, the mask will have a terminal metal stack. Evaporation is done in a high-vacuum environment.

Although evaporation is typically the method used to deposit the metal, other methods such as sputtering can also be used. Sputtering is often advantageous if aluminum is to be deposited; it permits aluminum alloys to be deposited with greater compositional fidelity than does evaporation.

In one specific application of the evaporation process, highlighted for purposes of example only, the molybdenum masks are aligned with the substrate wafer and the combination is held together with a stainless steel clamp ring. The metal deposition process is Cr, Cr/Cu, Cu, Au, and PbSn. After deposition is complete, the masks are separated from the substrate and the metal stack must be removed from the masks.

The following process steps typically are applied to chemically remove the metal stack from the molybdenum mask:

1. a solder stripper removes PbSn;
2. HCl removes the underlying Cr, Cu, and Au by undercut;
3. Alkaline $KMnO_4$;
4. HCl;
5. KI/I;
6. HCl;
7. Domestic and DI water rinses;
8. Freon; and
9. Oven dry.

There is a domestic water rinse after each chemical step but step number 8 (Freon).

Chemical processing attacks the base molybdenum of the mask, probably during the alkaline $KMnO_4$ and KI/I steps. Such attack influences the via size of the the mask and, therefore, limits the number of times or cycles a mask can be used for evaporation. Typically, masks can be reused only five or six times.

The chemical processing also leaves metallic residue stains on the mask. Such stains are a problem because the polyimide layer of the substrate has been found to contain particles of metal embedded in its surface after processing with stained molybdenum masks. In most cases, the residual stains are concentrated at the edges of the mask and form an outer ring. In some cases, however, the residuals spread over the entire surface of the mask to form an inner ring. Auger Emission Spectroscopy (AES) and X-Ray Photoelectron Spectroscopy (XPS) analyses of the residuals show that the residuals can be traced to the stainless steel clamp ring; the residuals include Fe, Ni, and C.

Several alternative chemical methods of cleaning the molybdenum masks have been investigated. To be successful, the method must remove the residue without attacking the base molybdenum. The amount of undesirable attack was evaluated by measuring the changes in via dimensions caused by the cleaning process. Measurements were taken at various positions in a molybdenum mask sample both before and after cleaning. An optical microscope with a digital micromeasuring device read the change in via diameter (Delta d).

Several chemical etchants were selected and studied based on their ability to remove steel and stainless steel layers. Moreover, the following solution is known to clean the surface of a molybdenum mask: 150 ml./liter concentrated nitric acid+300 ml./liter concentrated hydrochloric acid+150 ml./liter concentrated sulphuric acid+400 ml./liter water. See H. S. Hoffman, *Molybdenum Cleaning solution*, IBM Technical Disclosure Bulletin, vol. 3, no. 5 (Oct. 1960). Thus, hydrochloric acid and mixtures of hydrochloric and nitric acids of different proportions were used as chemical cleaning solvents. Table I summarizes the results.

TABLE I

CHEMICAL CLEANING OF MOLYBDENUM MASK RESIDUALS

| Solution | Cleaning time (min) | Delta d (micron) | Remarks |
|---|---|---|---|
| HCl (without dilution) | 35 | 0.4 | not cleaned |
| 0.1 $HNO_3$ + 0.9 HCl | 4 | 5.4 | clean |
| 0.1 $HNO_3$ + 0.9 HCl | 7 | 14.0 | clean |
| 0.5 $HNO_3$ + 0.5 HCl | 7 | 14.1 | clean |
| 0.02 $HNO_3$ + 0.98 HCl | 25 | 5.5 | clean |
| 0.05 $HNO_3$ + 0.95 HCl | 7 | 11.7 | clean |
| 0.01 $HNO_3$ + 0.99 HCl | 30 | — | no attack |
| 0.02 $HNO_3$ + 0.98 $H_2O$ | 30 | — | no attack |
| 0.05 $HNO_3$ + 0.95 $H_2O$ | 30 | — | no attack |
| 0.05 $HNO_3$ + 0.05 HCl + 0.9 $H_2O$ | 30 | — | no attack |

A mixture of 90–98 parts by volume of HCl and 2–10 parts by volume of $HNO_3$ removed the residual stains. A dark brown/black film formed on the surface of the mask, during the chemical cleaning process, requiring significant amounts of water rinsing to remove it. More importantly, a significant amount of molybdenum attack was observed under the conditions favorable to removal. The extent of attack was also a strong function of cleaning (exposure) time. Because of the observed molybdenum attack, the chemical cleaning processes, both conventional and those investigated in Table I, are unsuitable.

In contrast, the electrochemical cleaning method of the present invention has proven able to remove the mask residue without attacking the underlying molybdenum mask. FIG. 1 is a flow chart illustrating the process 25 of the present invention. A molybdenum mask is provided in step 30 stained by metallic residue during fabrication processing. The mask is made the anode in an electrolytic cell in step 40. Operating conditions of step 40 are chosen to induce preferential dissolution of the metallic stains; the underlying molybdenum remains completely passive while the residue actively dissolves. An electrolyte of phosphoric acid and glycerol (preferably 2 parts phosphoric acid and 1 part glycerol by volume) works well. Glycerol is a resistive electrolyte component particularly suitable for selective removal of protruding materials such as burrs.

Two sets of experiments were conducted to evaluate the electrochemical cleaning process 25. First, small pieces of samples were analyzed. The second set of experiments evaluated full-size samples. In each case, the mask (anode) was held vertically in the middle of a glass container. A 10-liter glass container was used to clean the full-sized masks. Two, parallel, stainless steel cathode plates of different sizes were held on opposite sides of, and about one inch from, the mask. A 1,000 watt, 20 volt, 50 ampere power supply was adequate for the second set of experiments.

The electrochemical cleaning was done at a constant voltage of 10 volts. On a micro-time scale, the anodic current jumped to a very high value (up to 18 amperes) for a full-size sample as the electrochemical process began, immediately dropped to very small values (about 0.1 ampere), then remained constant. A yellowish to light brown film formed commensurate with the current drop. Most of the residue was cleaned during the current rise; then formation of the film prevented significant anodic dissolution of the molybdenum. The surface film was easily removed by a water rinse.

Table II summerizes the results of experiments with the small samples.

TABLE II

ELECTROCHEMICAL CLEANING (Small Samples)

| Mask ID | Mask Passes | Voltage (V) | Cleaning time (min) | Delta d (micron) |
|---|---|---|---|---|
| A | 2 | 10 | 1.5 | 0.19 |
| A | 2 | 10 | 2 | 0.19 |
| B | 3 | 10 | 2 | 0.18 |
| B | 3 | 10 | 1.5 | 0.16 |
| B | 3 | 10 | 1.0 | 0.17 |
| B | 3 | 10 | 0.5 | 0.18 |
| C | 4 | 10 | 2.0 | 0.2 |
| C | 4 | 10 | 1.0 | 0.12 |
| C | 4 | 10 | 0.5 | 0.11 |
| D | 4 | 10 | 2.0 | 0.26 |
| D | 4 | 10 | 2.0 | 0.19 |
| D | 4 | 10 | 5.0 | 0.30 |

Table III presents the results of the full-size molybdenum mask samples.

TABLE III

ELECTROCHEMICAL CLEANING OF FULL SIZE MOLYBDENUM MASKS (Cell Voltage = 10 Volts)

| Mask ID | Mask Passes | Ring Type | Cleaning Time (min) | Delta d (micron) |
|---|---|---|---|---|
| A | 1 | center | 2 | 0.15 |
| B | 2 | outer | 2 | 0.13 |
| C | 3 | center | 2 | 0.23 |
| D | 4 | outer | 2 | 0.07 |
| E | 5 | center | 2 | 0.19 |
| F | 6 | center | 2 | 0.13 |
| G | 7 | outer | 2 | 0.14 |

The change in diameter (Delta d) values in Tables II and III above represent an average value of ten measurements from a sample. The results show that the dimensional change of about 0.2 microns after electrochemical cleaning is within the precision of the measurement technique applied. Moreover, the electrochemical cleaning process is fast: after a period of at most two minutes, the results are independent of cleaning time.

To adapt the electrochemical process 25 of the present invention successfully into the fabrication process, two variables of the process were further investigated. First, the influence of cleaning time on the extent of molybdenum attack was evaluated. Second, the effect of a neutralizer on the rinsing water step was studied.

Turning first to the cleaning time variable, electrochemical cleaning was done at both 5 volts and at 10 volts. As observed above, the anodic current jumped when power was supplied—to about 18 amperes for the 10-volt cells and about 8 amperes for the 5-volt cells—then immediately dropped to, and remained constant at, between 0.04 and 0.08 amperes. The yellowish brown film was again observed adhering to the surface upon current drop. It required significant rinsing water for removal. The cell voltage had little influence on the steady state current, indicating that the cell voltages of 5 and 10 volts correspond to a current plateau region in which surface films are formed.

The electrochemical cleaning time was varied to determine its effect on the extent of any molybdenum attack. At 5 volts, experiments were conducted at dissolution times of 2, 5, and 20 minutes. At 10 volts, experiments were conducted at dissolution times of 0.5, 2, 5, 10, and 20 minutes. The metal residue was cleaned in each case, even at the minimum cleaning times tried (2 minutes for the 5-volt tests; 0.5 minutes for the 10-volt tests). The via size was about the same whether the 2-minute cleaning was done in one step or in four separate steps of 30 seconds each, interrupted by rinsing and drying. Moreover, no significant increase in via size was found in any of the samples. Thus, it can be concluded that electrochemically cleaned molybdenum masks can be used at least twenty times—an increase by a factor of four over the conventionally cleaned masks (which can be cycled about five times).

The effect of a neutralizer on the rinsing water step was also studied. The surface film formed during electrochemical cleaning adheres to the surface of the mask and requires a significant amount of water rinse to remove it. In the experiments discussed above, a jet of distilled water was used at step 60 to remove the surface film and electrolyte layer. The surface films formed at 5 volts adhered better than those formed at 10 volts. Thus, the 5-volt samples required more rinsing water. At a given cell voltage, low cleaning time caused more adherent films.

Attempting to reduce the rinsing water requirement of step 60, a neutralization step 50 was introduced. Step 50 includes dipping the mask in a 0.05 M NaOH solution before the final rinsing in a water jet. The effect of step 50 on the rinsing water required in step 60 was marginal. Step 50 did yield samples, however, which were cleaner and free of water stains. The step 70 of drying the mask follows the rinsing step 60 and results in a cleaned, stain-free molybdenum mask.

Figure 2A:
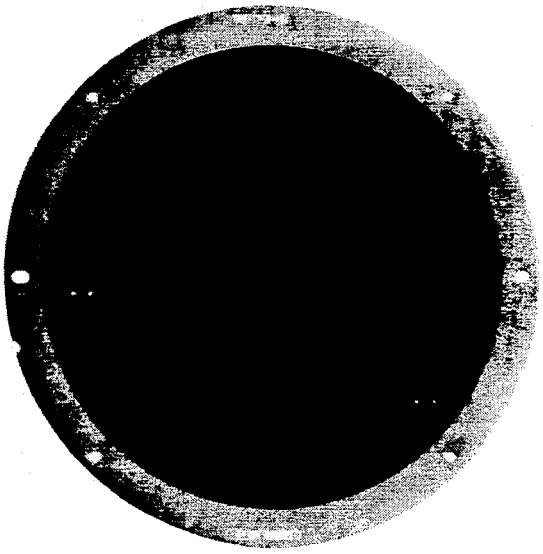
FIG. 2 shows two optical photographs of molybdenum masks taken before (2A) and after (2B) the process of the present invention was applied.
Figure 2B:
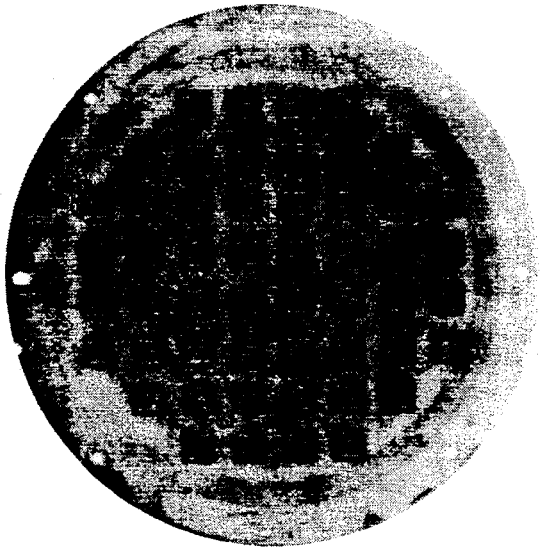

FIG. 2 shows two optical photographs of five-inch molybdenum masks taken before (FIG. 2A) and after (FIG. 2B) the process 25 of the present invention was applied to remove its residual, metallic stains.

Figure 3:
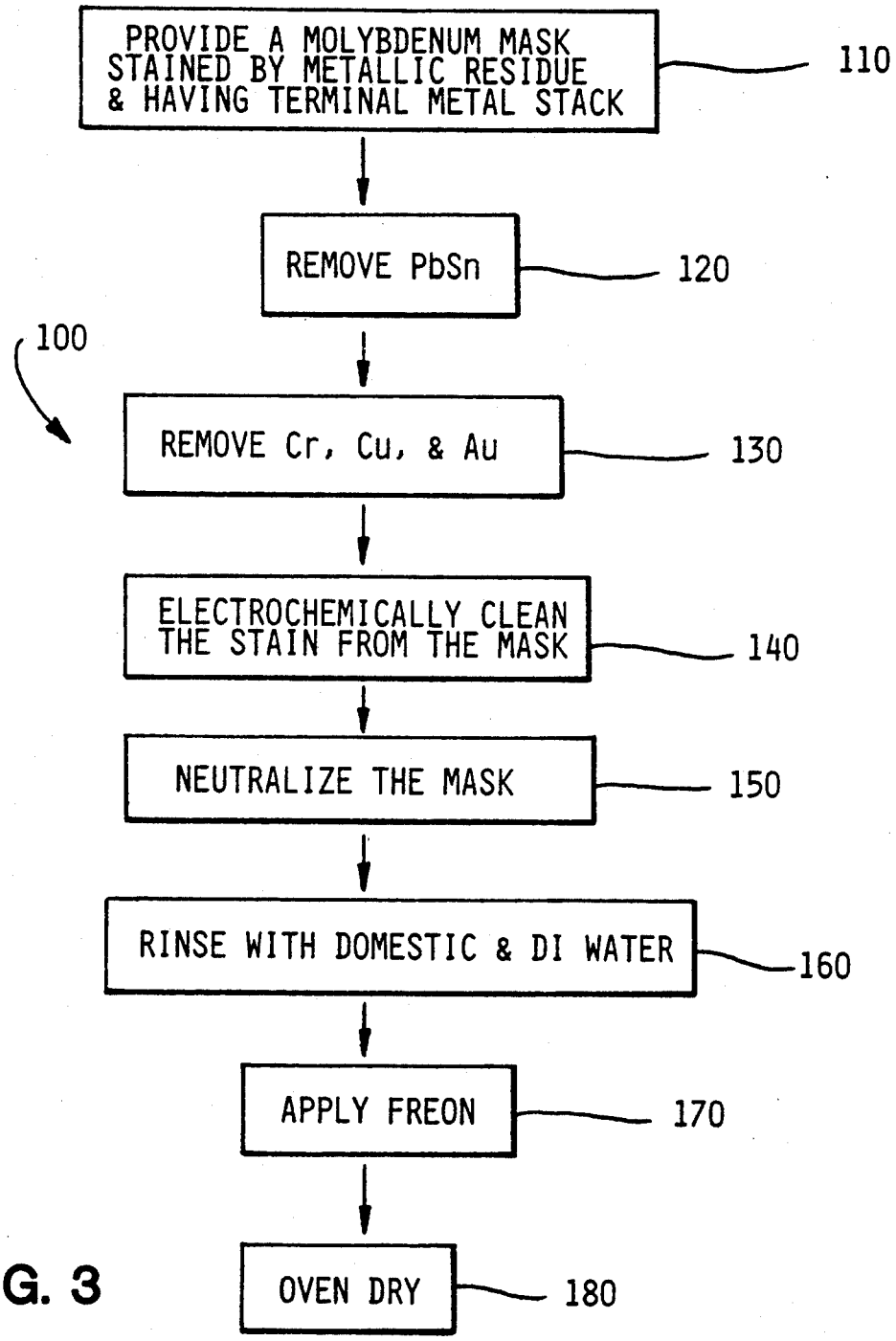
FIG. 3 is a flow chart illustrating the process of the present invention as combined with a conventional chemical cleaning process.

The benefits of the electrochemical process of the present invention can be incorporated into the conventional chemical cleaning process discussed above as used for the specific application of the evaporation highlighted. The electrochemical process can replace several steps of the conventional process, especially the treatment in alkaline $KMnO_4$ and in the KI/I mixture. The resulting, combined process will remove terminal metal stack without increasing via size or leaving residue stains. FIG. 3 outlines the steps of such a process.

Specifically, FIG. 3 is a flow chart illustrating the combined chemical and electrochemical process 100 of the present invention. A molybdenum mask is provided in step 110 stained by metallic residue during fabrication processing. The metallic residue is formed during selective physical vapor deposition by evaporation of terminal metals on the substrate. The metal deposition process is Cr, Cr/Cu, Cu, Au, and PbSn. Once deposition is complete, the mask, stained by the metallic residue, is removed from the substrate.

First, in step 120, the PbSn is removed from the mask. A solder stripper is suitable for that task. The deposited Cr, Cu, and Au are then removed, in step 130, by undercut using HCl. Thus far chemically cleaned, the mask is made the anode in an electrolytic cell in step 140. Operating conditions of step 140 are chosen to induce preferential dissolution of the metallic strains; the underlying molybdenum remains completely passive while the residue actively dissolves. An electrolyte of phosphoric acid and glycerol (preferably 2 parts phosphoric acid and 1 part glycerol by volume) works well.

To reduce the rinsing water requirement of step 160, a neutralization step 150 may be introduced. Optional step 150 includes dipping the mask in a 0.05 M NaOH solution. Then, in step 160, the mask is rinsed using a water (domestic and DI) jet. After applying Freon in step 170, the mask is oven dried in step 180. A domestic water rinse should be incorporated after each of the chemical steps, except step 170 (Freon), outlined above.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. An electrochemical method for selective removal of metallic residual stain from a molybdenum mask comprising:

(a) providing a molybdenum mask stained by metallic residue;

(b) forming an electrolytic cell having:

(i) said mask as the anode, (ii) an electrolyte of phosphoric acid and glycerol, (iii) a cathode, and (iv) a power supply;

(c) electrochemically cleaning said mask in said electrolytic cell to form a surface film and electrolyte layer on said mask which includes said metallic residual stain;

(d) rinsing said mask with water to remove said surface film and electrolyte layer on said mask which includes said metallic residual stain; and (e) drying said mask.

2. A method as claimed in claim 1 wherein said electrolyte is two parts phosphoric acid and one part glycerol by volume.

3. A method as claimed in claim 1 wherein the step (c) electrochemically cleaning said mask in said electrolytic cell lasts for at most approximately two minutes.

4. A method as claimed in claim 1 further comprising neutralizing said mask before the step (d) of rinsing said mask with water.

5. A method as claimed in claim 4 wherein said neutralizing step includes dripping said mask in a solution of NaOH.

6. A method as claimed in claim 1 wherein the step (d) of rinsing said mask with water includes directing a jet of distilled water toward said mask.

7. A method as claimed in claim 1 wherein said cathode is a pair of parallel, stainless steel plates.

8. A method as claimed in claim 1 wherein the step (c) of electrochemically cleaning said mask in said electrolytic cell is done at a constant voltage of between 5 and 10 volts.

9. An electrochemical method for selective removal of metallic residual stain from a molybdenum mask comprising:

(a) providing a molybdenum mask stained by metallic residue;

(b) forming an electrolytic cell having:

(i) said mask as the anode, (ii) an electrolyte of two parts phosphoric acid and one part glycerol by volume, (iii) a cathode, and (iv) a power supply;

(c) electrochemically cleaning said mask in said electrolytic cell, to form a surface film and electrolyte layer on said mask which includes said metallic residual stain, for at most approximately two minutes;

(d) rinsing said mask by directing a jet of distilled water toward said mask to remove said surface film and electrolyte layer on said mask which includes said metallic residual stain; and (e) drying said mask.

10. A method as claimed in claim 9 further comprising neutralizing said mask before the step (d) of rinsing said mask with water.

11. A method as claimed in claim 10 wherein said neutralizing step includes dripping said mask in a solution of NaOH.

12. A method as claimed in claim 9 wherein said cathode is a pair of parallel, stainless steel plates.

13. A method as claimed in claim 9 wherein the step (c) of electrochemically cleaning said mask in said electrolytic cell is done at a constant voltage of between 5 and 10 volts.

14. A combined chemical and electrochemical method for selective removal of terminal metal stack and metallic residual stain, which comprises Fe, Ni, C, Cr, Cr/Cu, Cu, Au, and PbSn, from a molybdenum mask, said method comprising:

(a) providing a molybdenum mask stained by the metallic residue and having terminal metal stack;

(b) chemically removing PbSn from said mask;

(c) chemically removing Cr, Cu, and Au from said mask;

(d) forming an electrolytic cell having:

(i) said mask as the anode, (ii) an electrolyte of two parts phosphoric acid and one part glycerol by volume, (iii) a cathode, and (iv) a power supply;

(e) electrochemically cleaning said mask in said electrolytic cell, to form a surface film and electrolyte layer on said mask which includes said metallic residual stain, for at most approximately two minutes;

(f) rinsing said mask by directing a jet of distilled water toward said mask to remove said surface film and electrolyte layer on said mask which includes said metallic residual stain;

(g) applying Freon to said mask; and (h) drying said mask.

15. A method as claimed in claim 14 further comprising rinsing said mask with water after the steps (a) and (b).

16. A method as claimed in claim 14 further comprising neutralizing said mask after the step (e) of electrochemically cleaning said mask.

17. A method as claimed in claim 16 wherein said neutralizing step includes dipping said mask in a solution of NaOH.

18. A method as claimed in claim 14 wherein the step (b) of chemically removing PbSn uses a solder stripper.

19. A method as claimed in claim 14 wherein the step (c) of chemically removing Cr, Cu, and Au is done by undercut using HCl.

* * * * *